US006632302B2

(12) United States Patent
Fisher et al.

(10) Patent No.: US 6,632,302 B2
(45) Date of Patent: Oct. 14, 2003

(54) METHOD AND MEANS FOR HEAT TREATING CUTTING TOOLS

(76) Inventors: Geoffrey Philip Fisher, 160 Netherton Rd, Worksop, Notts, S80 2SF (GB); Richard Mark Lill, 18 Woodlands Ave, Beighton, Sheffield, S20 1BP (GB); Edgar Dabill, 63 Windsor Walk, South Anston, NR Sheffield, S25 5EL (GB); Martin John Monaghan, 21 Father's Gardens, Kiveton Park, Sheffield (GB); Jonathan Clifford Oates, 16 Worral Drive, Worrall, Sheffield, S35 0AT (GB); Graham Monteith Smith, Five Oaks, Park Edge, Hathersage, Hope Valley, Sheffield, S30 1BS (GB)

( * ) Notice: Subject to any disclaimer, the term of this patent is extended or adjusted under 35 U.S.C. 154(b) by 0 days.

(21) Appl. No.: 09/915,314

(22) Filed: Jul. 27, 2001

(65) Prior Publication Data

US 2002/0157739 A1 Oct. 31, 2002

(30) Foreign Application Priority Data

Jul. 28, 2000 (GB) ..... 0018616

(51) Int. Cl.[7] ..... C21D 9/22; F27D 5/00

(52) U.S. Cl. ..... 148/640; 266/258; 432/253

(58) Field of Search ..... 266/274, 249, 266/252, 258, 44; 432/253; 148/640

(56) References Cited

U.S. PATENT DOCUMENTS

| | | | | | |
|---|---|---|---|---|---|
| 4,441,698 | A | * | 4/1984 | Limque et al. | 266/274 |
| 4,763,880 | A | * | 8/1988 | Smith et al. | 266/252 |
| 4,911,415 | A | * | 3/1990 | Lohse et al. | 266/274 |
| 5,052,923 | A | | 10/1991 | Peter et al. | |
| 5,143,558 | A | * | 9/1992 | Smith | 266/252 |

FOREIGN PATENT DOCUMENTS

| | | |
|---|---|---|
| EP | 0 422 353 A2 | 4/1991 |
| GB | 2 095 383 | 9/1982 |
| GB | 2 167 170 A | 5/1986 |
| WO | WO 90/12266 | 10/1990 |

* cited by examiner

*Primary Examiner*—Scott Kastler
(74) *Attorney, Agent, or Firm*—Larson & Taylor PLC

(57) ABSTRACT

Apparatus for heat treating a cutting tool comprises a furnace and a tool holder within the furnace adapted to receive therein a first portion of the tool, a second portion of the tool projecting from the tool holder, the second portion of the tool being directly exposed to radiant heat from at least one radiant heating element within the furnace with the first portion of the tool being shielded from the radiant heat.

11 Claims, 5 Drawing Sheets

Hardened in Carbolite

Hardened in salt

METHOD AND MEANS FOR HEAT TREATING CUTTING TOOLS

BACKGROUND OF THE INVENTION

This invention relates to the heat treatment of cutting tools, in particular, although not necessarily exclusively, the heat treatment of cutting tools such as twist drills having a shank and a cutting portion to which it is desired to impart different hardness.

BACKGROUND ART

Cutting tools such as twist drills, milling tools, reamers, countersinks and the like include a cutting portion, formed with a number of cutting edges, and a shank by which the tool is held, for example in a collet chuck or other holder of for example a lathe, machine drill or hand drill. It is common practice to harden the cutting portion of these tools in order that they can cut efficiently. However, it is undesirable to harden the shanks to the same degree, because a relatively soft shank is required if the chuck or other holder is to grip the tool securely.

These cutting tools are typically manufactured from steel, most usually a high-speed steel. The process by which they are hardened is a heat treatment process, in which blanks for the tools are heated up to a temperature of about 1150–1230° C., at which temperature they are held for a sufficient length of time to ensure that the blank is heated to its core. The blank is then rapidly cooled (i.e. quenched) to effect the change in microstructure that gives the steel its hardness. Hardening of other ferrous and non-ferrous metals can be achieved in a similar manner with suitable heat treatment regimes.

To give the desired differential hardening (fully hardened cutting portion/soft shank), the conventional approach is to use a salt bath for the heat treatment. The cutting portion of the tool is immersed in the liquid salt, which is held at the necessary high temperature. The shank remains clear of the bath and consequently remains at a temperature which is not sufficiently high for any appreciable hardening to occur.

The use of a salt bath in this way can reliably produce tools having the desired hardness characteristic, and is still the most common method of hardening used today. However, the process does have drawbacks, most notably the environmental and safety concerns associated with the toxic, extremely high-temperature molten salts used in the bath, which also give rise to difficult and unpleasant working conditions for the operator of the process.

More recently, it has been proposed to differentially harden cutting tools by treating them in a three-stage vacuum furnace, the tools progressing in a linear fashion through three chambers in the furnace. The tools are loaded in batches into the first chamber which is closed and then evacuated. After a predetermined amount of time, the batch of tools is then moved into the second chamber, which is already under vacuum, and which is held at a high temperature in order to heat the tools to the desired hardening temperature. Having been held in the heated chamber for an appropriate amount of time, the tools are then transferred to the third chamber. Here they are quenched by pumping nitrogen gas into the chamber under high pressure.

To achieve the desired differential cooling, the tools are held within the chambers of the furnace in carriers, in the form of large metal blocks formed with recesses in which the tool shanks are received. The carriers shield the shanks to some degree from the heated interior of the chamber. However, the temperature of the carriers themselves will increase, particularly where the heat treatment regime dictates that the tools must be held in the heating chamber for any significant length of time, possibly resulting in some unwanted hardening of the shanks. This problem can be exacerbated if the carriers are not allowed to cool sufficiently between batches of tools. The rapid cooling by blasting the tools with nitrogen may also lead to undesirable distortion.

Moreover, the furnace must be sealed from its surrounding environment, and within the furnace the three chambers must be separately sealed, in order that the necessary vacuum can be maintained, leading to a relatively complex and expensive design of furnace. It is perhaps for this reason that the salt bath still predominates, despite its drawbacks mentioned above.

SUMMARY OF THE INVENTION

The present invention has as its general aim the provision of heat treatment apparatus and methods for differentially hardening two portions of a cutting tool which offers an economic and reliable alternative to the conventional, and ever less desirable, salt baths.

In one aspect, the invention provides apparatus for heat treating a cutting tool, comprising a furnace within which there is at least one radiant heating element and a tool holder adapted to receive and shield a first portion of the tool from the heating element whilst a second portion of the tool is directly exposed to radiant heat from said element.

In another aspect, the invention provides a heat treatment method for hardening a metal tool, the method comprising directly exposing a first portion of the tool to a source of radiant heat in a furnace to raise the temperature of said first portion to an elevated temperature, and shielding a second portion of the tool from said source of radiant heat to maintain it at a temperature lower than the elevated temperature of said first portion.

The term "tool" used herein is intended to include blanks and semi-finished blanks for tools as well as finished tools themselves.

By exposing the tools directly to a source of radiant heat it has been found possible to accurately control the differential heating of the two portions of the tool.

This control is enhanced when, as is preferred, the radiant heat source is arranged to lie alongside the tools when they are being heated in the furnace. In this case, it may also be arranged that the heat source, i.e. the heating element, does not extend alongside or at most extends only partially alongside the tool holder in which a portion of the tool is shielded. This further exaggerates the differential heating of the two portions of the tool.

Another particularly preferred measure to increase the temperature differential between the two portions of the tools, is to actively cool the tool holder. For instance air, water or some other cooling fluid may be forced through or around the tool holder or some other heat conducting element that is thermally coupled to the tool holder, whereby heat can be drawn away from the holder.

It is of course more economical to treat batches of tools at one time, and for this reason the furnace may be arranged such that a plurality of tools can be simultaneously exposed to the heating element. For instance, a row or two-dimensional array of tools may be held in one or more tool holders adjacent the element. To ensure a more uniform heating of the tools, two heating elements may be arranged, one either side of the tools, for example to lie parallel with a row of tools. This principle can be extended to layouts including two or more rows or arrays of tools extending parallel to one another, these rows or arrays being held in tool holders within corridors defined between opposed heating elements, e.g. three rows of tools held in three parallel corridors defined by four heating elements.

Where the tools are treated in batches, it is particularly preferred that each tool is directly exposed to radiant heat from at least one heating element, without being shielded or partially shielded from that element by any of the other tools of the batch. Typically, with the configuration of heating elements described above, this will mean that the tool holders should be arranged to hold at most two parallel rows of tools. Even then, it is desirable to offset the rows from one another such that the tools are fully exposed to the heating element to one side of the batch and only partially shielded from the element to the other side of the batch.

The furnace preferably also includes means for rapidly cooling the tool or tools subsequent to exposure to the heating element(s). Particularly preferred for this purpose are one or more cooling elements adjacent which a row or array of tools can be disposed in a tool holder, much in the same way as they are held alongside the heating element. The cooling elements, which may for example be cooled themselves by a flow of water or other cooling fluid, absorb heat radiating from the tools to help prevent the atmosphere around the tools increasing significantly in temperature, encouraging rapid cooling of the tools.

Similar to the heating elements, parallel rows of cooling elements may be arranged within the furnace to define one or more corridors for the tools.

Conveniently, the furnace may be divided into a heating zone in which the tools are heated by radiant heat and a separate cooling zone in which the tools are cooled, transport means being provided to take the tools from one zone to the other. A particularly convenient form of furnace that can be adopted for this approach is a rotary hearth furnace, in which the tools are carried by a rotating support or hearth, e.g. in their tool holder, through an annular chamber, which may be sub-divided into different temperature zones.

DESCRIPTION OF THE PREFERRED EMBODIMENTS

Figure 1:
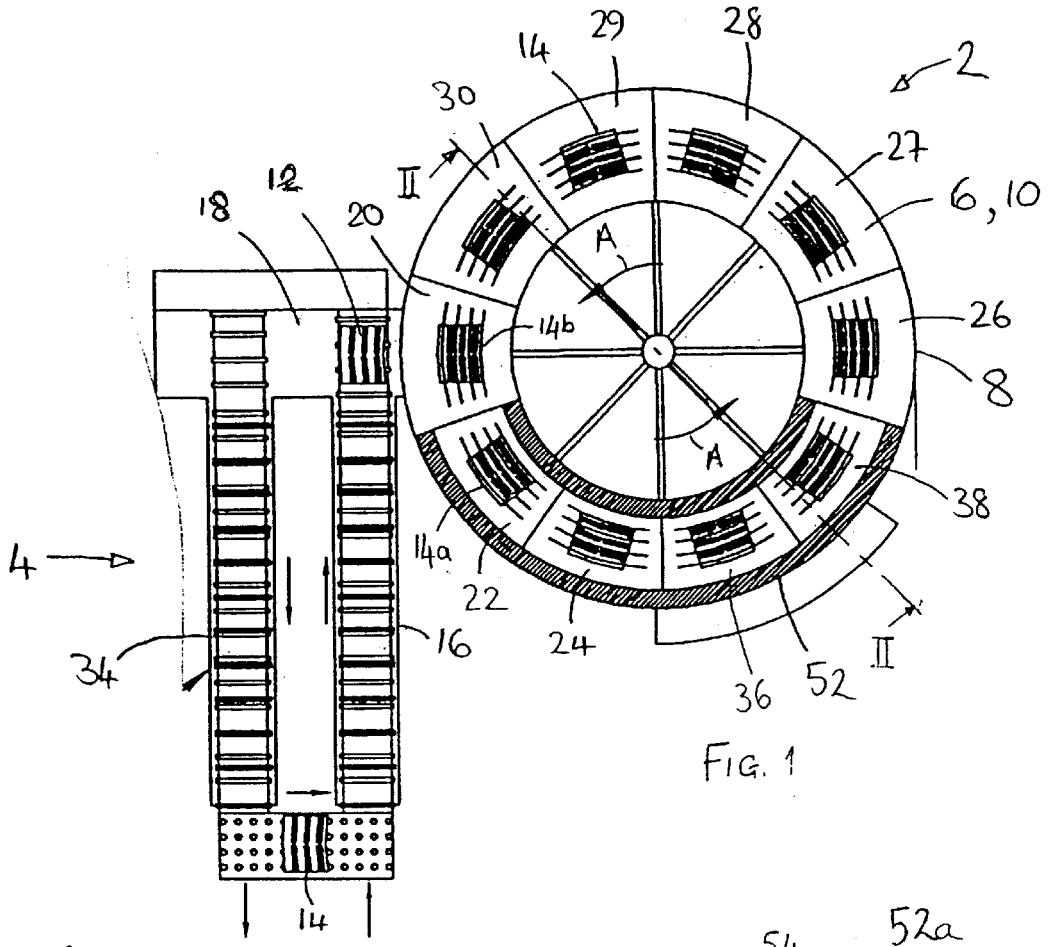
FIG. 1 is a part sectioned plan view of a rotary hearth furnace according to an embodiment of the present invention.

Referring to FIG. 1, a rotary hearth furnace 2 is shown along with an associated load and unload conveyor system 4. The furnace is designed for heat treating tool blanks, in this example blanks for twist drills formed from high speed steel (HSS).

The annular interior of the furnace 2 is divided into ten equally sized zones 6 around its circumference. Likewise, the rotary hearth 8 of the furnace 2 is sub-divided into ten equal segments 10, each segment 10 being adapted for transporting a batch of tool blanks 12 sequentially through the zones 6 of the furnace in a tool carrier 14 as the hearth is indexed through ten corresponding positions.

The furnace is operated at or very near ambient atmospheric pressure. That is to say it is not evacuated. In this preferred embodiment, the furnace atmosphere (i.e. the atmosphere within the furnace) is nitrogen gas. This helps prevent discolouration of the blanks, and possible de-carburisation of the steel which might occur if they were exposed to oxygen at the high temperatures at which the furnace operates (1150–1230° C.).

In use, tools are loaded in batches into the carriers 14, which then travel along the load conveyor 16 to arrive one at a time at transfer table 18. From here, the carrier 14 is loaded into the furnace 2, onto a segment 10 of the hearth 8 in a load/unload zone 20 of the furnace 2. The hearth is then indexed by the length of one segment 10, in the anti-clockwise direction as indicated by arrows A in FIG. 1, taking the just loaded carrier 14*a* into the first of two pre-heat zones 22, 24, and bringing another carrier 14*b* from the last of five cooling zones 26–30 into the load/unload zone 20. The carrier 14*b* is then extracted from the furnace 2 onto the transfer table 18, from where it travels along the unload conveyor 34, which runs parallel with but in the opposite direction to the load conveyor 16. The now heat treated, hardened tool blanks are then removed for further processing (e.g. flute grinding, etc.).

In subsequent indexing steps, the carrier 14*a* and the segment 10 of the hearth on which it sits are taken sequentially through the second pre-heat zone 24, two high temperature heating zones 36, 38 and the five cooling zones 26, to return to the load/unload zone 20. The pre-heat zones 22, 24 serve to bring the temperature of the blanks up to about 900° C., prior to their being exposed to the very high temperatures in the heating zones 36, 38. This avoids very rapid heating of the blanks 12, which might lead to undesirable distortion. The time spent in the two heated zones 36, 38, in which the tool blanks 12 are elevated to a temperature of about 1200° C., is sufficient to ensure that the blanks 12 are heated through to their cores. The blanks are then rapidly cooled as they enter the first cooling zone 26, very quickly cooling to a temperature of about 600° C. As they pass through the remaining four cooling zones 27–30, the blanks 12 then cool down to around ambient temperature before being discharged from the furnace 2.

Insulation 'bridges' (not shown)—that is to say insulating members which span the width of the furnace interior, but which do not encroach on the passage of the tool blanks—are located between the second high temperature zone and the first cooling zone and between the cooling zones themselves. It is notable that this arrangement of the zones, with the tool blanks being loaded and unloaded to and from a cool zone, which is separated from the heated zones not only by the insulating bridges, but also by the two pre-heat zones, leads to only very little loss of heat from the furnace to the surrounding environment.

Each time the hearth 8 is indexed, one carrier 14 holding treated tool blanks is unloaded from the load/unload zone 20, to be replaced with a carrier holding new blanks ready for treatment. In this way, the process can operate continuously in a very efficient manner, with both loading and unloading of the carriers taking place at the same location. Advantageously, the rotary hearth design of furnace 2 also takes up a relatively small amount of floor space, particularly when compared with the known vacuum furnaces.

Figure 2:
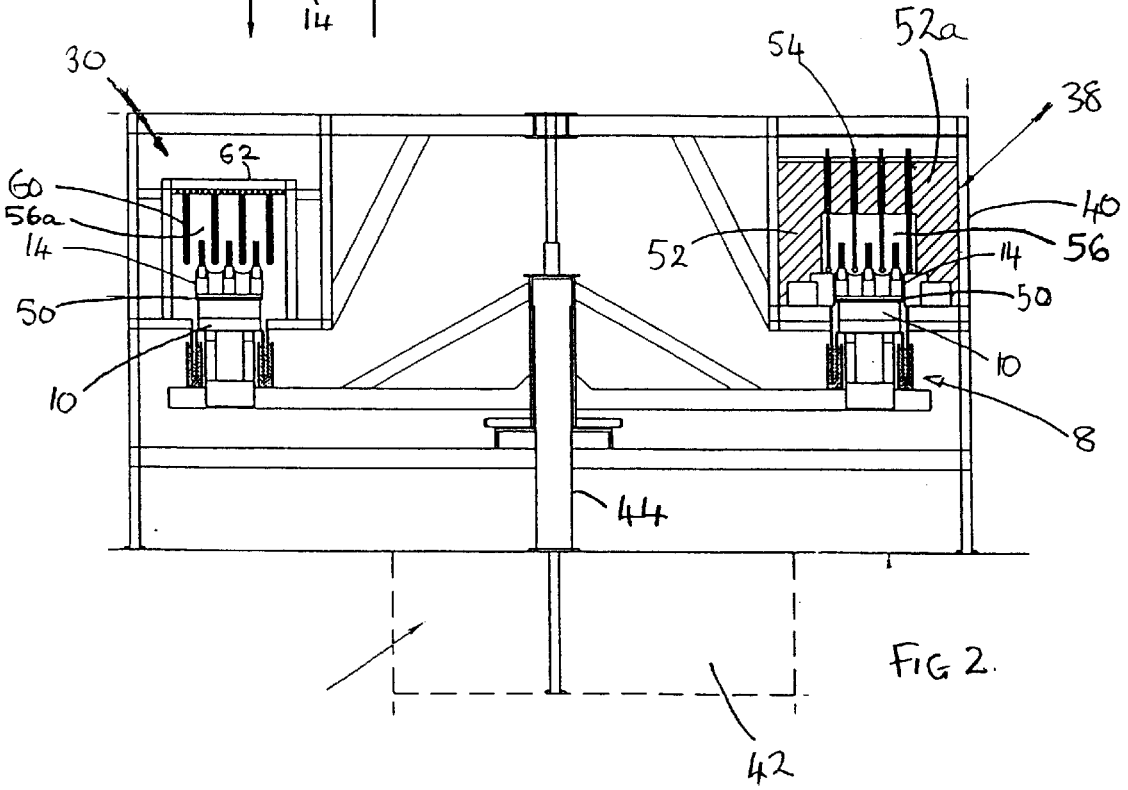
FIG. 2 is a section, on a slightly enlarged scale, along line II—II of FIG. 1.
Figure 3:
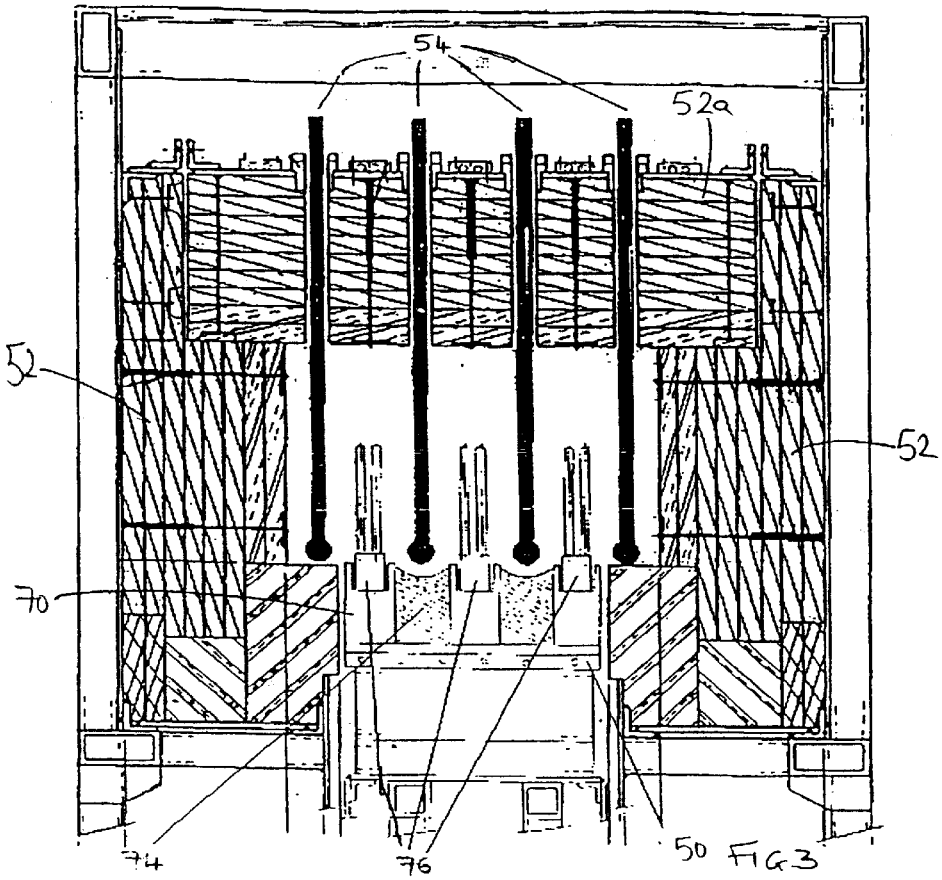
FIG. 3 shows in cross-section, the heating zone of the furnace of FIG. 1.
Figure 4:
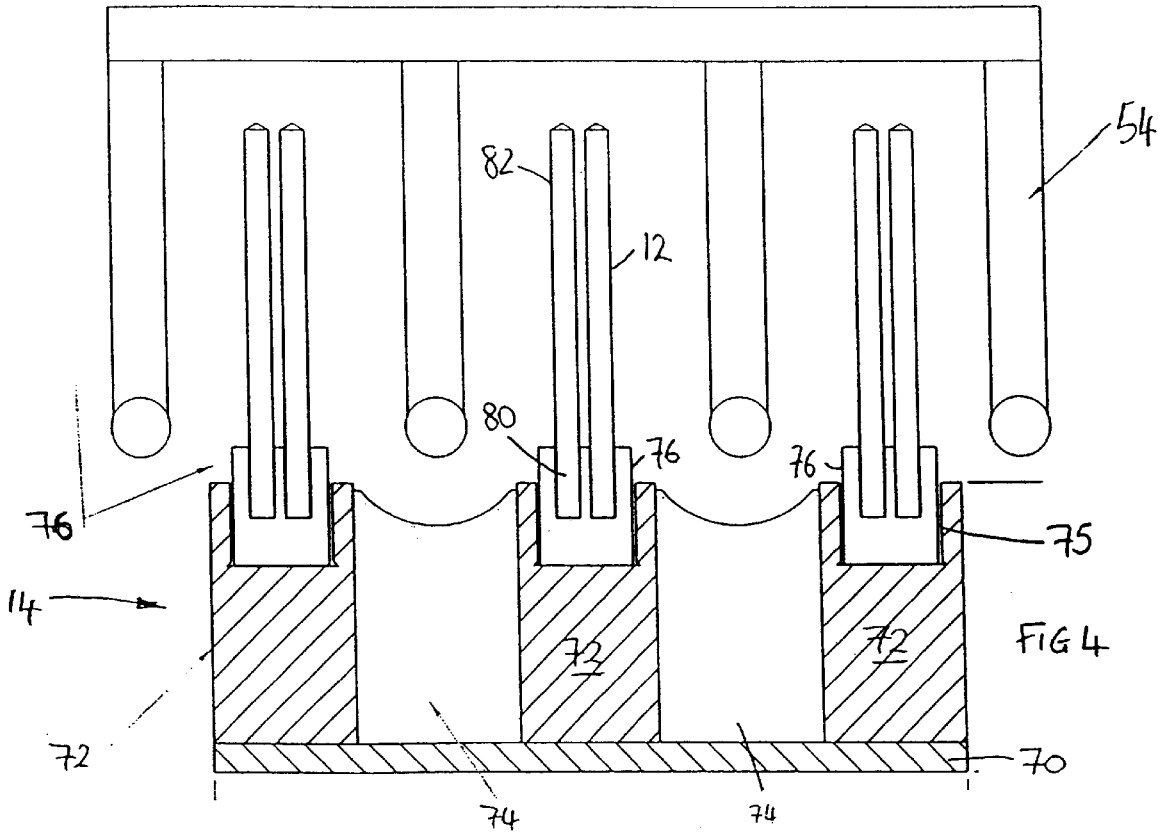
FIG. 4 shows somewhat schematically, on an enlarged scale the central portion of the heating zone illustrated in FIG. 4.

Turning to FIGS. 2, 3 and 4, the construction of the furnace will now be explained in more detail. As seen best in FIG. 2, which shows a section through one of the heating zones 38 on the right and one of the cooling zones 30 on the left, the hearth 8 of the furnace is mounted for rotation within a housing 40. An opening (not shown) is formed in the housing 40 adjacent the load/unload zone 20, through which the tool carriers 14 can be introduced and removed. A pit 42 below the furnace houses a motor (not shown) to drive a rotor 44 to which the hearth 8 is mounted and by which it is driven to move the segments 10 of the hearth 8 step-wise through the zones 6 of the furnace 2. Any of a variety of indexing mechanisms may be used for this drive, including for example a globoidal cam indexing mechanism. Such a mechanism is particularly preferred because, although it is simple in construction, it can very accurately index the hearth 8 (e.g. within ±1.0 mm).

Mounted on each hearth segment 10 is a base plate 50 of mild steel (MS). These plates 50 are water cooled, water being pumped (e.g. at about 3–4 bar) through channels provided in the plate for this purpose. The coolant is supplied under pressure to each base plate 50 from a common supply via the hub of the hearth 8, from where the coolant is transferred to the plates 50 through flexible pipework. A fitting at the hub allows for relative rotation between a stationary supply pipe and the pipework rotating with the hearth, whilst maintaining a flow of coolant from one to the other.

The tool carrier 14, the structure of which is described further below, stands on the base plate 50, such that it is in thermal communication with the base plate to be cooled by it.

The heating zones 36, 38, as well as the pre-heat zones 22, 24 are enclosed at their sides and top by a thick layer of an insulating material 52, to help maintain the necessary elevated temperature in these zones. The insulation 52*a* across the top of the heated zones 36, 38, and the second pre-heat zone 24 is broken to allow an array of heating elements 54, in this example four side by side in each zone, to protrude through the insulation from above into the interior of the furnace. The elements are preferably electrically conducting elements which rely on resistance heating, allowing their temperature to be accurately and rapidly controlled. Silicon carbide elements have been found to be particularly suitable.

The first pre-heat zone 22 does not contain any heating elements in this example, instead being heated by radiated and/or convected heat from the second pre-heat zone 24.

The heating elements 54 are equally spaced from one another across the width of the heated zone 38 to define between them three circumferentially extending passages 56 of equal width along which the tool blanks 12 travel as the hearth 8 is indexed. This arrangement, along with the design of the tool carrier 14 (described below) ensures that all of the blanks 12 are uniformly heated by radiant heat from the elements 54. It is to be noted in particular that, unlike the known vacuum furnace described above, the elements 54 are arranged to be very closely spaced from the tool blanks 12, allowing very accurate control of the heating of the blanks 12. Typically, the spacing between an element and an adjacent tool will be about 50 mm or less, although the precise spacing for any particular batch of tools can be selected dependent on the heat treatment regime they require, by adjusting the position of the blanks in their carrier 14.

Further control is effected by monitoring the temperature in the high temperature heating zones 36, 38 of the furnace and the second pre-heat zone 24, for example using standard thermocouples, and controlling the power to the heating elements to maintain the desired temperatures in these zones. In a typical set up, six thermocouples in each of these three zones would be adequate to give the desired control. The three zones are preferably independently controlled. By way of example, typical temperatures in the three controlled zones would be about 1000° C. in the second pre-heat zone 24, about 1200° C. in the first high temperature heating zone 36, and about 1230° C. in the second high temperature zone 38. Actual values may be varied dependent on factors such as the desired heat treatment regime and the material of the tools being treated.

In the cooling zones 26–30, which are not insulated, cooling elements 60 depend downwardly from a roof member 62 in a similar array-like fashion to the heating elements 54, defining continuations 56*a* of the passages 56 defined between those elements 54. The cooling elements are aluminium blocks, which similarly to the base plates 50, are formed with channels through which cooling water is pumped, in this example at about 3–4 bar pressure. This arrangement can provide for very rapid, yet controlled cooling of the blanks 12, which is less harsh than the nitrogen quench of the known furnace, resulting in minimal if any distortion.

As already noted, the blanks are carried through the furnace 2 in tool carriers 14. Referring to FIGS. 3 and 4, each of these carriers has an MS base 70 on which are mounted three MS heat sinks 72, which are equally spaced across the width of the base and extend for the full length of the base 70. The spaces between the heat sinks 72 are filled with an insulating refractory material 74.

Figure 5:
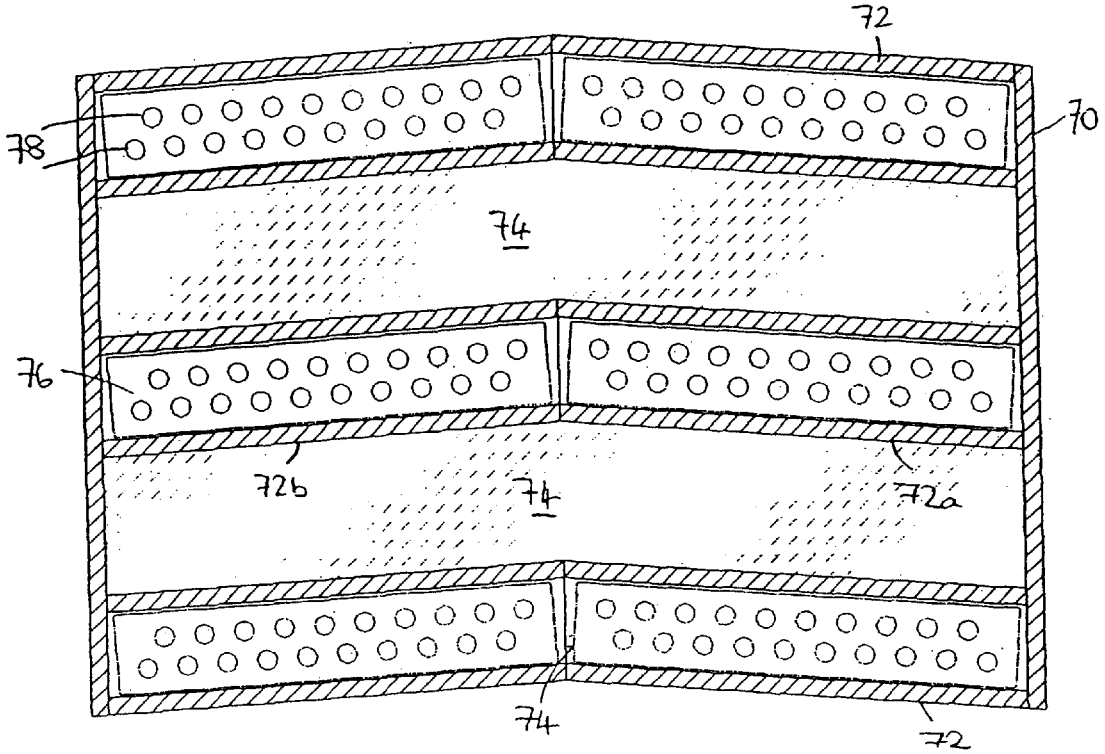
FIG. 5 is a plan view of a tool carrier, on a much enlarged scale, for use in the furnace of FIG. 1.

As seen in FIG. 5, the heat sinks 72 are each formed from two MS blocks 72*a*, 72*b*, joined mid-way along the length of the base 70, which are offset at a small angle to one another so that the line of each heatsink 72 approximates to the curvature of the hearth 8 on which they are carried. The base 70 is similarly shaped. The positions of the heatsinks 72 across the width of the base 70 is such that they coincide with the passages 56, 56*a* defined by the heating and cooling elements 54, 60.

In the top surface of each block 72*a*, 72*b* of the heat sink 72, there is formed an elongate recess 75, extending for the full length of the block. Received snugly in this recess is a tool holder 76, also of MS, in the top surface of which are formed a uniformly spaced series of holes 78 sized to accept the shank ends 80 of the tool blanks 12 to be treated. When received in the holders 76, the tool blanks protrude upwardly so that their cutting portions lie between the heating elements 54 as they travel through the heating zones 56, 58 of the furnace 2. In this way, the cutting portions are exposed to the radiant heat from the elements 54, whilst the shanks are shielded within the holders, which are themselves disposed below the level of the heating elements (see FIGS. 3 and 4).

The tool holders 76, which are themselves cooled by the water-cooled base plate 50 through the heatsinks 72, also serve to conduct heat away from the shank 80 when it is in the furnace 2. This, together with the shielding they provide, ensures that the temperature of the shanks 80 is kept below about 800° C., so they are not hardened to any significant degree.

The division between the soft shank end 80 of the tool blank 12 and the hardened cutting portion 82 can be controlled by the depth of the holes 78 in the tool holder, the deeper the holes the longer the soft shank 80. The transition between the hardened and soft portions of the blank will not coincide precisely with the depth of the hole, due to the effects of conduction of heat through the blank itself, but it is a matter of simple experimentation to determine the relationship between hole depth and the location of the transition for any particular design of tool.

Figure 6A:
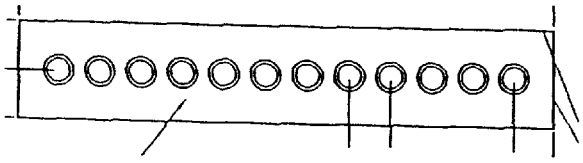
FIGS. 6*a*, 6*b*, 7*a* and 7*b* are plan and end views of alternative heat sink blocks for the tool carrier seen in FIG. 5.
Figure 6B:
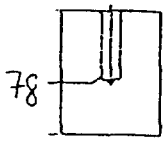
Figure 7A:
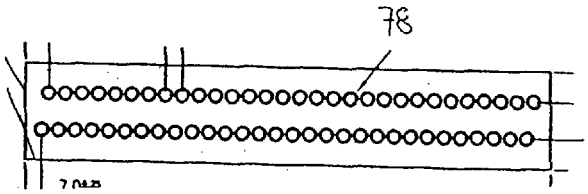
Figure 7B:
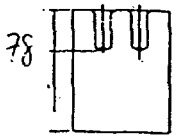

The degree of hardening will also be influenced significantly by the spacing between the tool blanks 12 and the heating elements 54 in the furnace 2. This can be controlled by appropriate positioning of the holes 78 in the tool holders 76. Different diameter tool blanks will also require different hole arrangements to ensure that they are uniformly heated. The tool holders 76 seen in FIG. 5, having two staggered rows of holes 78 in each holder, would be appropriate, for example, for tools having a diameter of about 8–10 mm. For larger diameter tools, a single row of holes, as seen for example in FIGS. 6*a* and 6*b* would be more appropriate, whereas smaller diameter tools can be packed more tightly (FIGS. 7*a* and 7*b*).

Advantageously, this approach to accommodating different size tools means that only the tool holders 76 need be changed for different tool batches. A further advantage is that a great degree of control is given over the hardening process by the variables in the described furnace structure, including the position of the heat sinks, the flow of cooling water, the amount of insulation between the heat sink blocks, and the spacing and depth of the holes in the tool holders, the particular optimum parameters for any form of tool, taking into account also the temperatures and time spent in the furnace, being deducible by experimentation. This in turn means that the furnace operating parameters need not necessarily be altered for different forms of tools, the characteristics of the heat treatment process instead being controlled through an appropriate selection of the heat sinks and holders. This has the great advantage that different forms of tool can follow one another through the furnace without any significant time loss.

Figure 8A:
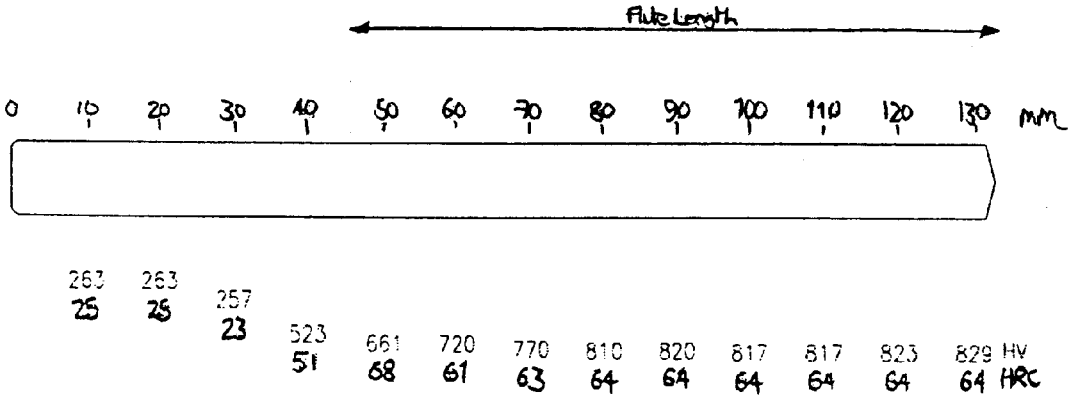
FIGS. 8*a* and 8*b* show hardness profiles for blanks for a 10 mm diameter "jobber drill" (twist drill) heat treated respectively by a process according to an embodiment of the present invention (FIG. 8*a*) and a molten salt bath process (FIG. 8*b*)
Figure 8B:
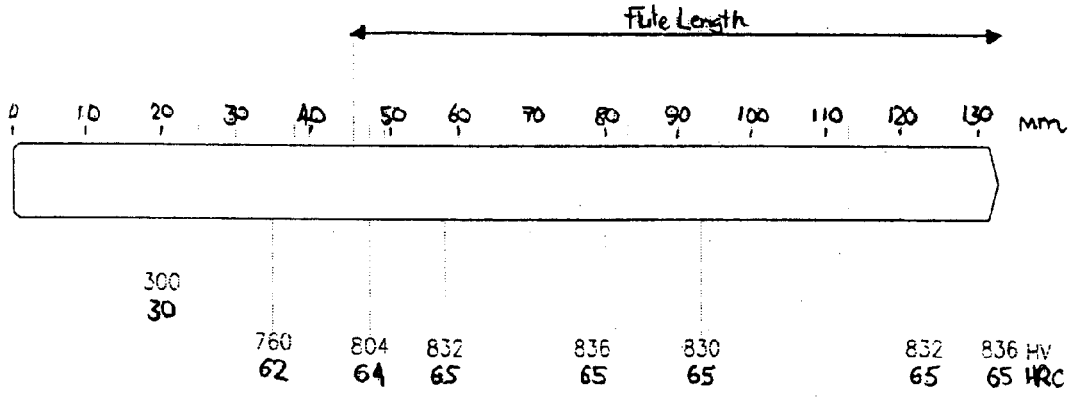

FIGS. 8*a* and 8*b* illustrate the effectiveness of the heat treatment process possible using the furnace described above. Specifically, if one compares the hardness characteristic of two identical tool blanks (in this example blanks for 10 mm diameter HSS twist drills), one treated in a rotary hearth furnace in accordance with the invention (FIG. 8*a*) and the other in a conventional salt bath (FIG. 8*b*), it can be seen that similar hardness of the cutting portions (i.e. "flute length") is achieved by both processes, whereas the shank of the blank treated in accordance with the present invention is, if anything, softer than that arrived at conventionally. Moreover, tests have shown that this approach produces very consistent final hardness figures, attributable to the re-produceable heating and cooling profiles that can be achieved for each cycle of work.

Figure 9:
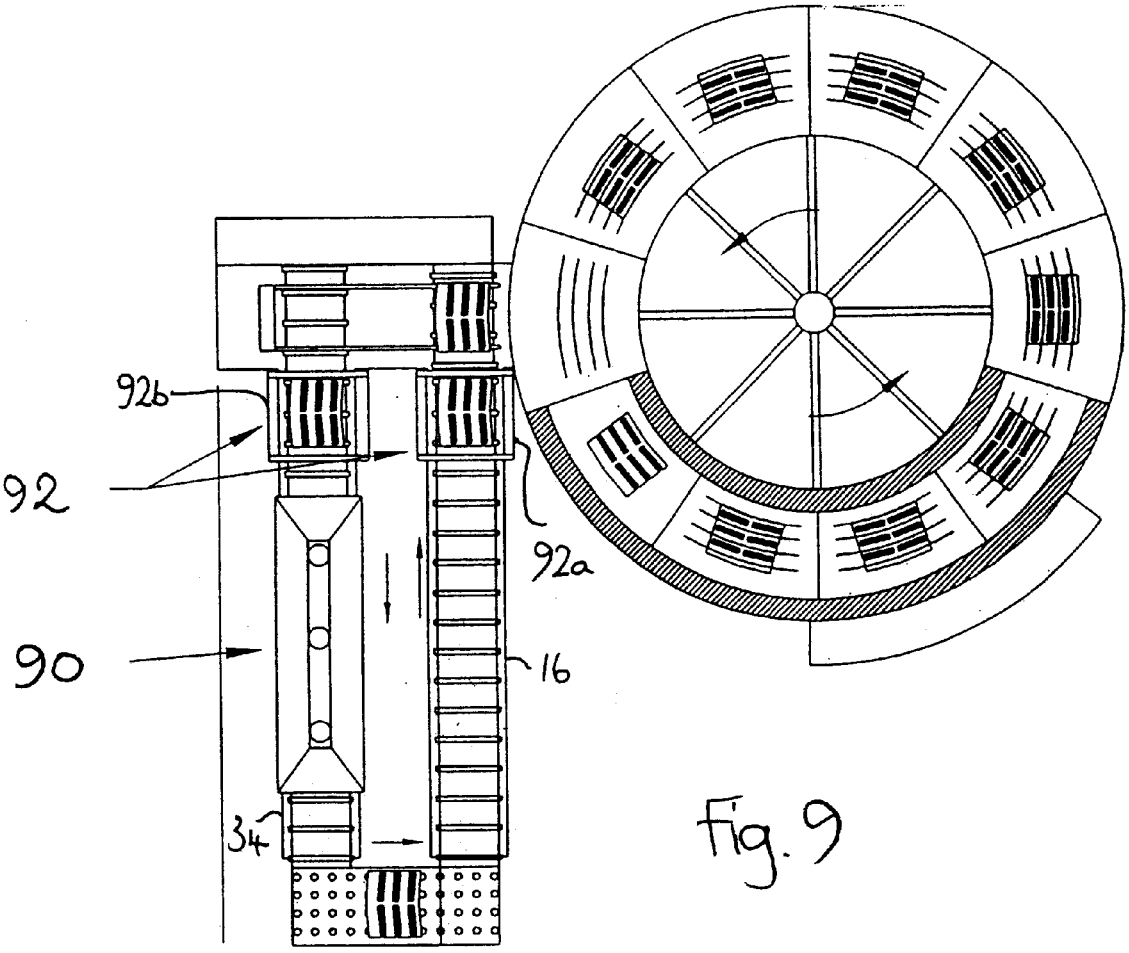
FIG. 9 is a view similar to FIG. 1, illustrating a modification to the load/unload conveyor arrangement.

As will be appreciated, the specific example described above is intended to be illustrative, and many modifications to the apparatus described can be made without departing from the invention. For instance, as illustrated in FIG. 9, additional cooling may be provided by cooling fans 90 positioned above the unload conveyor 34. This figure also illustrates vacuum locks 92 which are provided in this example to stop the ingress of oxygen into the furnace during loading and unloading of the tools. During loading, the tools enter the vacuum lock chamber 92*a* at the end of the load conveyor 16. Doors on either side of the chamber seal the chamber, and the gas within the chamber is pumped down to approximately $1\times10^{-2}$ m bar. The chamber is then back-filled with $N_2$ gas from the furnace. The tools are then loaded into the furnace through the inner chamber door (ie. the one that opens to the furnace load zone). This scheme substantially prevents any oxygen entering the furnace.

Vacuum lock 92*b* operates in a similar way when the tools are unloaded from the furnace onto the unload conveyor 34.

What we claim and desire to secure by Letters Patent:

1. Apparatus for heat treating a plurality of cutting tools comprising a furnace (2) and one or more tool holders (14) within the furnace (2) for travel through the furnace, the or each tool holder (14) being adapted to receive therein a first portion of each tool of a row of tools (12), with a second portion of each tool (12) projecting therefrom, radiant heating elements (54) within the furnace (2), the second portion of each tool (12) being directly exposed to radiant heat from said elements (54), and the first portion of each tool (12) being shielded from said heat, the furnace (2) being divided into one or more heating zones (36, 38) in which the tools (12) are heated, and one or more separate cooling zones (26) in which the tools (12) are cooled, wherein a plurality of heating elements (54) are disposed within at least one heating zone (36, 38) to define therebetween, for the or each tool holder (14), a corridor through which the associated tool holder (14) passes, the heating elements (54) being positioned to each side of the or each tool holder (14), to lie alongside the second portions of the tools (12) as they pass sequentially through the at least one heating zone (36, 38), and a plurality of cooling elements (60) are disposed within at least one cooling zone (26) to define therebetween, for the or each tool holder (14), a corridor through which the associated tool holder (14) travels subsequent to passage through the or each heating zone (36, 38), the or each corridor in a cooling zone or zones (26) forming a continuation of an associated corridor in a heating zone (36, 38), the cooling elements (60) being liquid cooled and being positioned to each side of the or each tool holder (14) to lie alongside the second portions of the tools (12) as they pass through the at least one cooling zone (26), and wherein the heating elements (54) and the cooling elements (60) are positioned at equal distances from each side of the individual tools (12) such that each tool (12) is uniformly heated and subsequently uniformly and rapidly cooled.

2. Apparatus for heat treating a plurality of cuffing tools comprising a furnace (2) and one or more tool holders (14) within the furnace (2) for travel through the furnace, the or each tool holder (14) being adapted to receive therein a first portion of each tool of two parallel rows of tools (12), with a second portion of each tool (12) projecting therefrom, radiant heating elements (54) within the furnace (2), the second portion of each tool (12) being directly exposed to radiant heat from said elements (54), and the first portion of each tool (12) being shielded from said heat, the furnace (2) being divided into one or more heating zones (36, 38) in which the tools (12) are heated, and one or more separate cooling zones (26) in which the tools (12) are cooled, wherein a plurality of heating elements (54) are disposed within at least one heating zone (36, 38) to define therebetween, for the or each tool holder, a corridor through which the associated tool holder (14) passes, the heating elements (54) being positioned to each side of the or each tool holder, to lie alongside the second portions of the tools (12) as they pass sequentially through the at least one heating zone (36, 38), and a plurality of cooling elements (60) are disposed within at least one cooling zone (26) to define therebetween, for the or each tool holder (14), a corridor through which the associated tool holder (14) travels subsequent to passage through the or each heating zone (36, 38), the or each corridor in a cooling zone or zones (26) forming a continuation of an associated corridor in a heating zone (36, 38), the cooling elements (60) being liquid cooled and being positioned to each side of the or each tool holder (14) to lie alongside the second portions of the tools (12) as they pass through the at least one cooling zone (26), and wherein the heating elements (54) and the cooling elements (60) to each side of the tool holder(s) (14) are positioned at equal distances from the tools of an adjacent row of tools (12) such that each tool (12) is uniformly heated and subsequently uniformly and rapidly cooled.

3. Apparatus as claimed in claim 1 or claim 2 in which the heating elements (54) do not extend alongside, or at most extend only partially alongside, the or each tool holder (14) in which the first portions of the tools (12) are shielded.

4. Apparatus as claimed in claim 1 or claim 2 and further comprising means (50) for cooling the or each tool holder (14).

5. Apparatus as claimed in claim 1 or claim 2 and including transport means (8, 44) for taking the tools (12) from one zone to the next zone.

6. Apparatus as claimed in claim 1 or claim 2 which the furnace (2) is a rotary hearth furnace.

7. Apparatus as claimed in claim 1 or claim 2 in which the atmosphere of the furnace (2) is nitrogen gas.

8. Apparatus as claimed in claim 7 and including one or more vacuum lock chambers **(92*a*, 92*b*) through which the tools (12) and tool holders (14) are loaded and unloaded into and out of the furnace (2) such as to prevent the ingress of oxygen into the furnace (2)** during said loading.

9. Apparatus as claimed in claim 1 or claim 2 including one or more pre-heating zones (22, 24) located prior to the one or more heating zones (36, 38).

10. A method of heat treating a plurality of cutting tools (12) to harden the tools (12) comprising the steps of directly exposing a second portion of each tool (12) to a source of radiant heat (54) in a furnace (2) to raise the temperature of said second portion to an elevated value, shielding a first portion of each tool (12) from said source of radiant heat (54) to maintain it at a temperature lower than the elevated temperature of the second portion, exposing the second portions of the tools (12) of the or each row to a plurality of heating elements (54) positioned to each side of, to lie alongside the second portions of, the tools (12), the heating elements being positioned at equal distances from the tools (12) to define a corridor therebetween and whereby the individual tools (12) are uniformly heated, and exposing the second portions of the tools (12) of the or each row of tools (12) to a plurality of liquid-cooling elements (60) positioned at equal distances from the tools (12) to define a corridor therebetween forming a continuation of the corridor between the heating elements (54) and through which the tools (12) pass subsequent to the heating step, whereby the tools (12) are uniformly and rapidly cooled.

11. A method as claimed in claim 10 and further including the steps of locating the first portions of the tools (12) in at least one tool holder (14), and cooling the or each tool holder (14).

* * * * *